United States Patent [19]

Pelaez

[11] 3,986,283

[45] Oct. 19, 1976

[54] NOVELTY POST CARD

[76] Inventor: Pedro R. Pelaez, 4040 W. 7th Lane, Hialeah, Fla. 33010

[22] Filed: Mar. 6, 1974

[21] Appl. No.: 448,505

[52] U.S. Cl. ..... 40/125 A; 40/136; 40/158 R; 229/92.8

[51] Int. Cl.[2] ..... G09F 7/12

[58] Field of Search ..... 40/125 A, 135, 158 R, 40/2 R, 136, 125 F; 229/92.8

[56] References Cited

UNITED STATES PATENTS

| | | | |
|---|---|---|---|
| 878,556 | 2/1908 | Palm | 229/92.8 |
| 1,850,857 | 3/1932 | Weindel | 40/125 A UX |
| 2,191,704 | 2/1940 | Bennett | 40/125 A UX |
| 2,319,293 | 5/1943 | Braunstein | 229/92.8 |
| 3,346,172 | 10/1967 | Tucker | 229/92.8 |
| 3,506,528 | 4/1970 | Dean | 40/136 X |

FOREIGN PATENTS OR APPLICATIONS

| | | | |
|---|---|---|---|
| 1,809,794 | 7/1969 | Germany | 40/125 A |
| 7,988 | 1905 | United Kingdom | 229/92.8 |
| 951,215 | 3/1964 | United Kingdom | 229/92.8 |

*Primary Examiner*—John F. Pitrelli
*Attorney, Agent, or Firm*—Ernest H. Schmidt

[57] ABSTRACT

A novelty post card, injection molded of synthetic plastic material for substantial rigidity, wherein the artistic descriptive or humorous material is embossed on the face of the card and wherein the back of the card, in addition to the usual spaces for the addressee and a message, includes pressure-sensitive means for display mounting of the card against a mirror, wall or other smooth surface for display as a decorative plaque or picture by the recipient.

3 Claims, 5 Drawing Figures

NOVELTY POST CARD

This invention relates to post cards and is directed particuarly to a novelty post card of comparatively rigid, plaque-like construction provided with pressure-sensitive means along the back surface thereof for attachment against a flat surface, such as a mirror or wall, for use by the recipient as decoration.

The principal object of this invention is to provide a novelty post card which, instead of being discarded by the recipient as is usually done, is of such construction and so designed as to serve as a more or less permanent ornamental, decorative or humorous plaque that can readily be attached to a smooth surface for decorative purposes.

A more particular object of the invention is to provide a novelty post card of the above nature which can be molded of a synthetic plastic material with the decorative face of the card in bold relief to provide an attractive ornamental effect, and on the back of which, besides providing space for writing the name and address of the recipient and space for the usual message, also includes a pressure-sensitive adhesive device by means of which the card can easily be attached against a flat surface for permanent use as a decorative or humorous plaque or picture.

Still another object of the invention is to provide a novelty post card of the above nature wherein the pressure-sensitive attachment means is in the form of a strip of pressure-sensitive material extending centrally down the back of the card as a dividing line between the message and the addressee portions of the card, which strip is covered with a non-adhesive protective strip to be removed just prior to the attachment or mounting of the card by the recipient.

Yet another object of the invention is to provide a novelty post card of the character described which, because of its extremely low cost in quantity production, is particularly well-suited for use as an advertising give-away item.

Other objects, features and advantages of the invention will be apparent from the following description when read with reference to the accompanying drawings. In the drawings, wherein like reference numerals denote the corresponding parts throughout the several views.

Figure 1:
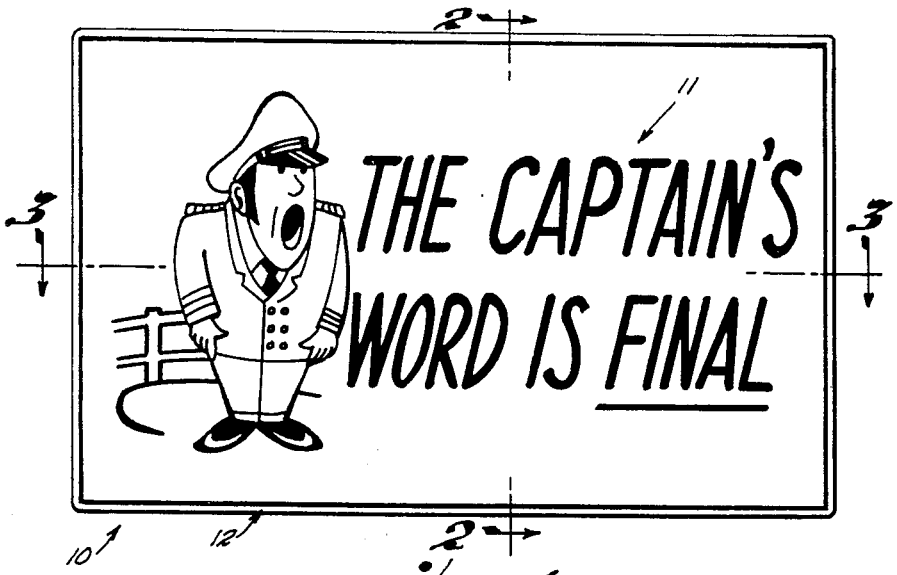
FIG. 1 is a plan view of the face of a typical novelty post card embodying the invention.
Figure 2:
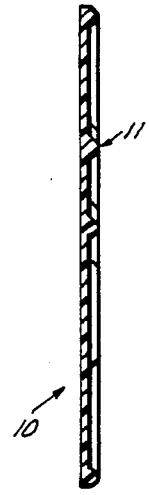
FIG. 2 is a transverse cross-sectional view taken along the line 2—2 of FIG. 1 in the direction of the arrows.
Figure 3:
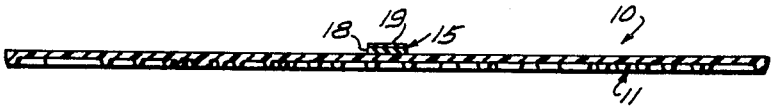
FIG. 3 is a longitudinal cross-sectional view taken along the line 3—3 of FIG. 1 in the direction of the arrows.

Referring now in detail to the drawings, reference numeral 10 in FIGS. 1, 2, 3 and 5, designate, generally, one form of a novelty post card embodying the invention, the same preferably being integrally molded of a tough synthetic plastic material in the rectangular size of an ordinary post card. As illustrated in FIGS. 1, 2 and 3, the decorative or humorous material on the face of the card, indicated generally at 11, is molded in bold relief, as is a peripheral margin indicated at 12. The outer surface areas of the relief structure lie in a common plane and are inked, such as by running an inking roller over the face of the card, to boldly set off the decorative or humorous material. Various striking effects can be obtained by molding the card 10 of a synthetic plastic material having a contrastingly different color than that of the ink used in setting off the raised decorative or humorous material on the face of the card. Preferably, the plastic material of which the card is injection molded will be of a light color, such as white, whereas the inking will be of a comparatively dark color, black for example.

Figure 5:
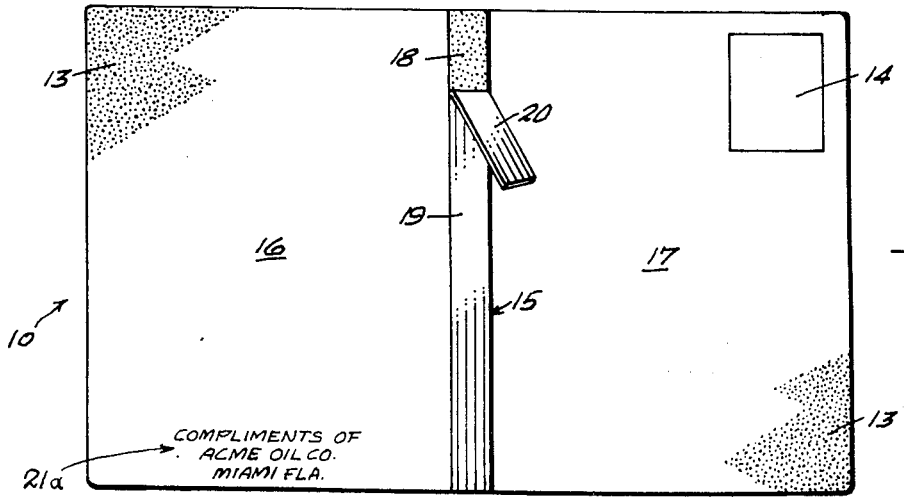
FIG. 5 is a plan view of the back of the novelty post card illustrated in FIG. 1 through 3.

As illustrated in FIG. 5, the back of the card will preferably be surface-treated, as indicated at 13, to provide a somewhat rough surface which will readily accept writing, whether by pencil or ink pen. As illustrated at 14, the upper right-hand corner may also be integrally molded with a light rectangular impression indicating placement for the postal stamp upon mailing.

As further illustrated in FIG. 5, an adhesive strip assembly 15 is secured against the back of the card, being centrally disposed in the vertical direction to divide the card into a message side 16 at the left of the card and an address side 17 at the right side. The adhesive strip assembly 15 is preferably in the form of an inner strip of pressure-sensitive adhesive material 18 which adheres against the card at its underside, and which is provided with a protective cover strip 19 at the outside. Upon receipt of the novelty post card, the recipient can readily peel away the protective cover 19, as partially indicated at 20, to expose the pressure-sensitive outer surface of the adhesive material 18, thereby enabling mounting the card against a mirror, wall or other smooth surface for more or less permanent use as a decorative or humorous plaque or picture.

As further illustrated in FIG. 5, advertising material indicated at 21a can be printed or otherwise impressed or integrally molded on the message side of the card, if the card is to be used as give-away advertising or promotional item.

Figure 4:
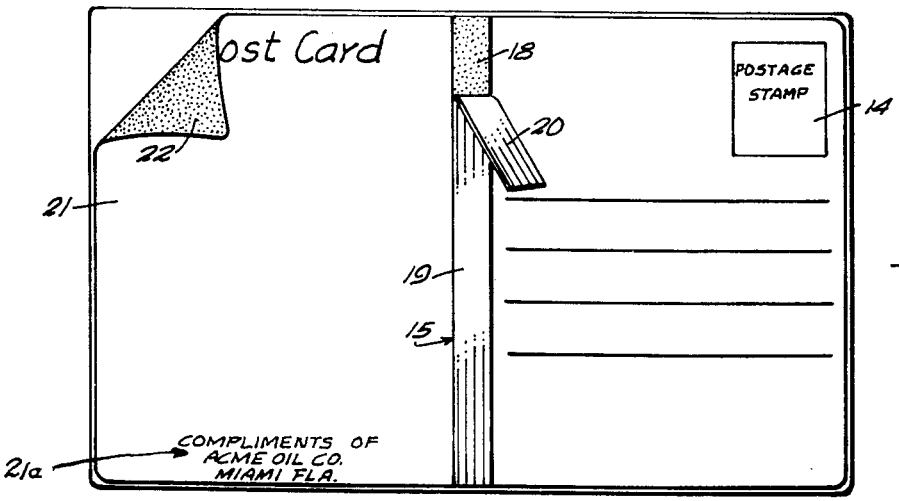
FIG. 4 is a plan view of the back of a modified form of novelty post card embodying the invention.

FIG. 4 illustrates a modification of the invention wherein a printed paper backing 21 is applied against the smooth back of an injection molded novelty post card embodying the invention. This embodiment of the invention is preferred when it is desired to print a substantial amount of advertising or other matter on the back of the card for any reason. In this embodiment of the invention the adhesive strip assembly 15 will be applied, subsequent to fixing of the paper backing 21. As illustrated at 22, the printed backing in 21 will preferably be secured against the back of the synthetic plastic card body as by rubber contact cement or the like.

While I have illustrated and described herein only two forms in which my invention can conveniently be embodied in practice, it is to be understood that these forms are given by way of example only, and not in a limiting sense. Thus, while the molded material on the face of the card is illustrated as being in the general category of humorous material, it will readily be understood that the characterization, pictorial representation or printed matter could take various forms suitable for decorative or informational use by the recipient. The invention, in brief, comprises all the embodiments and modifications coming within the scope and spirit of the following claims.

What I claim as new and desire to secure by Letters Patent is:

1. A novelty post card comprising a thin, rectangular card body member, said body member being integrally molded of a tough, synthetic plastic material of sufficient thickness to ensure substantial rigidity of said body member, the face of said body member being integrally molded, in relief, with pictorial matter, a paper backing member secured against the back of said card body member, the outside of said paper backing member being provided with pressure-sensitive means for mounting the card against a smooth surface for permanent display, said pressure-sensitive means comprising a strip of pressure-sensitive material affixed vertically against said paper backing member and dividing said paper backing member into substantially equal adressee and message portions, said strip of pressure-sensitive material being covered with a protective strip adapted to be removed by the recipient of the post card prior to attachment thereof against a smooth surface for display.

2. A novelty post card as defined in claim 1 including an advertising message imprinted upon said paper backing member.

3. A novelty post card as defined in claim 2 wherein said strip of pressure-sensitive material is covered with a protective strip adapted to be removed by the recipient of the post card prior to attachment thereof against a smooth surface for display.

* * * * *